US012108830B2

(12) United States Patent
Liang

(10) Patent No.: US 12,108,830 B2
(45) Date of Patent: Oct. 8, 2024

(54) PLANTAR ENERGY STORAGE BOOSTER AND PLANTAR BOOSTER

(71) Applicant: Botao Liang, Shenzhen (CN)

(72) Inventor: Botao Liang, Shenzhen (CN)

( * ) Notice: Subject to any disclaimer, the term of this patent is extended or adjusted under 35 U.S.C. 154(b) by 260 days.

(21) Appl. No.: 17/765,422

(22) PCT Filed: Nov. 30, 2020

(86) PCT No.: PCT/CN2020/132583
§ 371 (c)(1),
(2) Date: Mar. 30, 2022

(87) PCT Pub. No.: WO2021/121015
PCT Pub. Date: Jun. 24, 2021

(65) Prior Publication Data

US 2022/0354215 A1 Nov. 10, 2022

(30) Foreign Application Priority Data

Dec. 20, 2019 (CN) ..... 201911322146.7

(51) Int. Cl.
*A43B 13/18* (2006.01)

(52) U.S. Cl.
CPC ..... *A43B 13/181* (2013.01)

(58) Field of Classification Search
CPC ... A43B 13/183; A43B 13/185; A43B 13/181; A43B 13/184; A43B 13/182; A63B 25/10
See application file for complete search history.

(56) References Cited

U.S. PATENT DOCUMENTS 4,534,124 A * 8/1985 Schnell ..... A63B 25/10 36/114
5,826,350 A * 10/1998 Wallerstein ..... A43B 13/183 36/7.8
2014/0000125 A1* 1/2014 Butler ..... A43B 13/181 36/43

* cited by examiner

*Primary Examiner* — Sharon M Prange
*Assistant Examiner* — Grady Alexander Nunnery
(74) *Attorney, Agent, or Firm* — Novoclaims Patent Services LLC; Mei Lin Wong

(57) ABSTRACT

A plantar energy storage booster includes a fixed plate and an elastic plate. The elastic plate is located below the fixed plate, the front end of the elastic plate is fixedly connected to the front end of the fixed plate. In a natural initial state, the rear end of the elastic plate keeps an energy storage cap of a set distance from the rear end of the fixed plate in a vertical direction, so as to be deformed under the action of the impact force generated by feet landing and the gravity of the body to buffer and store energy. Along with the forward movement of the user, the elastic plate releases it stored energy to generate an upward and forward boosting force to the fixed plate and to drive a boosting mechanism to continue to generate an upward and forward force against the fixed plate.

8 Claims, 7 Drawing Sheets

PLANTAR ENERGY STORAGE BOOSTER AND PLANTAR BOOSTER

CROSS REFERENCE OF RELATED APPLICATION

This is a non-provisional application that claims priority to international application number PCT/CN2020/132583, international filing date Nov. 30, 2020, the entire contents of each of which are expressly incorporated herein by reference.

FIELD OF INVENTION

The present invention relates to an energy storage booster, and more particularly to a plantar energy storage booster which can effectively reduce the work done by a sporter.

BACKGROUND ARTS

Every time when people are walking or running, an action of their heels contacting the ground will cause a great impact to the bodies. Human body, including the bones, joints and muscles, is constructed to withstand and absorb such ground impact. It is worth mentioning that excessive ground impact or long-term ground impact will cause serious damages to the joints and bones of the human body. At the meantime, it is an energy waste for people to buffer and absorb the ground impact as a portion of the energy being consumed for walking and running, such that it will substantially reduce an efficiency and speed of walking and running.

SUMMARY OF THE PRESENT INVENTION

Technical Problem

The technical problem can be solved by the present invention providing a plantar energy storage booster and a plantar booster, which can store and effectively use the impact energy generated by heal landing of a sporter during walking and running, and can reduce the damages of counter-impact force generated by heel landing on ankle joints, knee joints and related bones.

Solution to the Problem

Technical Solutions

In order to solve the above problems, the technical solution employed by the present invention is:

The present invention provides a plantar energy storage booster, which is characterized in that it comprises a fixed plate and an elastic plate, wherein the fixed plate is placed on the sole of the foot and worn by the foot of a user, wherein a rear end of the fixed plate is configured to extend behind the heel of the user; wherein the elastic plate is made of highly elastic deformable material, wherein the elastic plate is formed in an arc-shape along its longitudinal sectional direction, wherein the elastic plate is located below the fixed plate, wherein in a natural initial state, the elastic plate has a front end fixedly connected to a front end of the fixed plate and a rear end spaced apart from a rear end of the fixed plate to define an energy storage gap therebetween in a vertical direction; wherein the energy storage gap is gradually reduced when the rear end of the elastic plate as a fulcrum is pressed downwardly via a vertical pressure applied by the heel to the fixed plate, at the meantime, wherein the elastic plate is forced to be deformed for storing portion of kinetic energy generated by the vertical pressure exerted by the heel to the fixed plate for deforming the elastic plate.

The energy storage gap is set between 30 mm and 150 mm.

The elastic plate further comprises a front supporting leg and a rear supporting leg provided at the front end and the rear end of the elastic plate respectively, wherein each of the front and rear supporting legs has a curved bottom surface.

A boosting mechanism is provided between the fixed plate and the elastic plate for converting the kinetic energy stored in the elastic plate into an upward and forward force to be applied to the fixed plate after the heel is lifted.

The boosting mechanism comprises a thrust assembly provided at mid-portions of the fixed plate and the elastic plate, and a starting assembly provided at the rear ends of the fixed plate and the elastic plate, wherein the starting assembly is configured to trigger the thrust assembly to start working after the heel is lifted, and the thrust assembly is driven by the starting assembly to generate the upward and forward force to the fixed plate.

The starting assembly comprises a guiding member provided at the rear end of the fixed plate, a driving rod provided at the rear end of the elastic plate and extended upwardly, and a swing lever pivotally coupled at a mid-portion of the fixed plate. The guiding member has a front end coupled at the fixed plate, wherein a guiding groove is upwardly extended and provided at a rear end of the guiding member. The starting assembly further comprises a ratchet tooth provided at an upper end of the driving rod, wherein a lower end of the driving rod is coupled to the elastic plate, wherein the driving rod with the ratchet tooth are arranged to move up and down along the guiding groove. The swing lever has an arc-shaped configuration and a width gradually increased from a rear end of the swing lever to a front end thereof, wherein at least one hanging tooth is provided at the rear end of the swing lever and the rear end of the swing lever is a free end, wherein the swing lever has an inclined lower surface inclinedly and upwardly extended from front to back, wherein a sliding groove is formed at the front inclined surface, wherein the thrust assembly is coupled at the sliding groove of the swing lever to slide up and down along the sliding groove. The ratchet tooth is able to freely slide at and pass the hanging tooth when moving upward from a bottom of the hanging tooth, and is engaged with the hanging tooth when moving downward from a top of the hanging tooth, wherein when the ratchet tooth is continuously moved downward via the driving rod, the ratchet tooth is configured to drive the swing lever to swing and push a lower end of the front inclined surface of the swing lever forward.

The thrust assembly comprises a reset spring, an upper link, a lower link, and a booster arm. Wherein the upper link has an upper end pivotally coupled at a mid-portion of the fixed plate, and a lower end pivotally coupled at an upper end of the lower link to form a suspended pivot hinge between the fixed plate and the elastic plate; the lower link has a lower end pivotally coupled to a mid-portion of the booster arm; the booster arm is formed in a circular arc-shaped plate configuration, wherein the booster arm has a front end as a free end, and a rear end pivotally coupled to the mid-rear portion of the elastic plate; the reset spring has an upper rear end fixedly coupled to the rear end of the fixed plate, and a lower front end coupled to the suspended pivot hinge; the suspended pivot hinge is movably coupled at the sliding groove formed at the front inclined surface of the swing lever through a short arm support shaft.

The upper link, the lower link, the booster arm, and the swing lever are placed between the fixed plate and the elastic plate. Wherein the upper link has an upper end pivotally coupled at a mid-portion of the fixed plate, and a lower end pivotally coupled at an upper end of the lower link to form a suspended pivot hinge between the fixed plate and the elastic plate; the lower link has a lower end pivotally coupled to a mid-portion of the booster arm; the booster arm is formed in a circular arc-shaped plate configuration, wherein the booster arm has a front end as a free end, and a rear end pivotally coupled to the mid-rear portion of the elastic plate; the swing lever has a mid-portion pivotally coupled at the fixed plate, a sliding groove formed at a front end of the swing lever to couple at the suspended pivot hinge, and a rear end extended to and on top of the rear end of the fixed plate; the swing lever is driven to move the suspended pivot hinge forward to enlarge an angle between the upper link and the lower link.

The plantar booster of the present invention, characterized in that: is formed by an upper link, a lower link, a booster arm, and a swing lever, wherein a lower end of the upper link, an upper end of the lower link and a front end of the swing lever are connected together; a lower end of the lower link is pivotally coupled at a mid-portion of the booster arm; an upper end of the upper link and a rear end of the booster arm are pivotally coupled at different height points of a plantar support respectively, such that by configuring the front end of the booster arm as a fulcrum and driving the swing lever to move forward, the upper end of the upper link is able to exert an upward thrust on the plantar support.

The upper link, the lower liner and the swing lever are made of rigid and high strength material.

Advantageous Effect of the Present Invention

Advantageous Effect

The plantar energy storage booster of the present invention is able to self-deform and buffer energy under the action of the impact force generated by feet landing and the gravity of the body. As the user moves forward, such as walking and running, i.e., an angle of the user's sole changes, the elastic plate is self-deformed to store energy and self-releases the energy to generate an upward and forward boosting force to the fixed plate worn at the user's sole, wherein the boosting mechanism is driven to continuously generate the upward and forward boosting force to the fixed plate. It can effectively reduce the damages of counter-impact force generated by heel landing on ankle joints, knee joints and related bones. It can effectively convert most of the impact ground energy into kinetic energy to store in the elastic plate. When the athlete's heel is lifted, it can convert the stored energy into the upward and forward boosting force on the sole of the athlete's foot to effectively reduce the work done by the athlete due to lifting of the feet during walking, relieve exercise fatigue and improve the speed of the movement and the fun of exercise.

BRIEF DESCRIPTION OF THE DRAWINGS

Description of the Drawings

Figure 1:
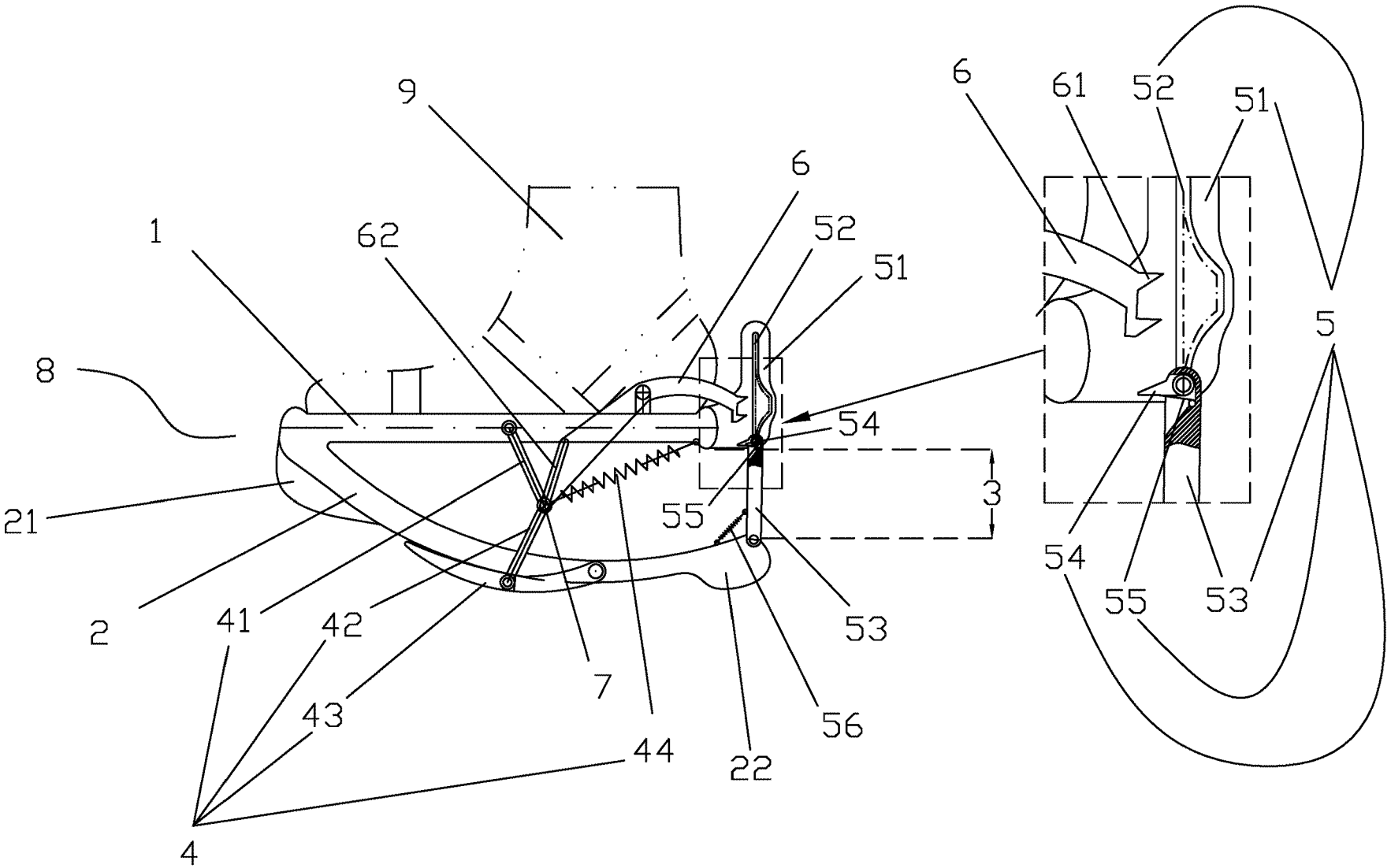

FIG. 1 is a schematic view of a plantar energy storage booster at a natural initial state and worn by an athlete's foot according to a preferred embodiment of the present invention.

Figure 2:
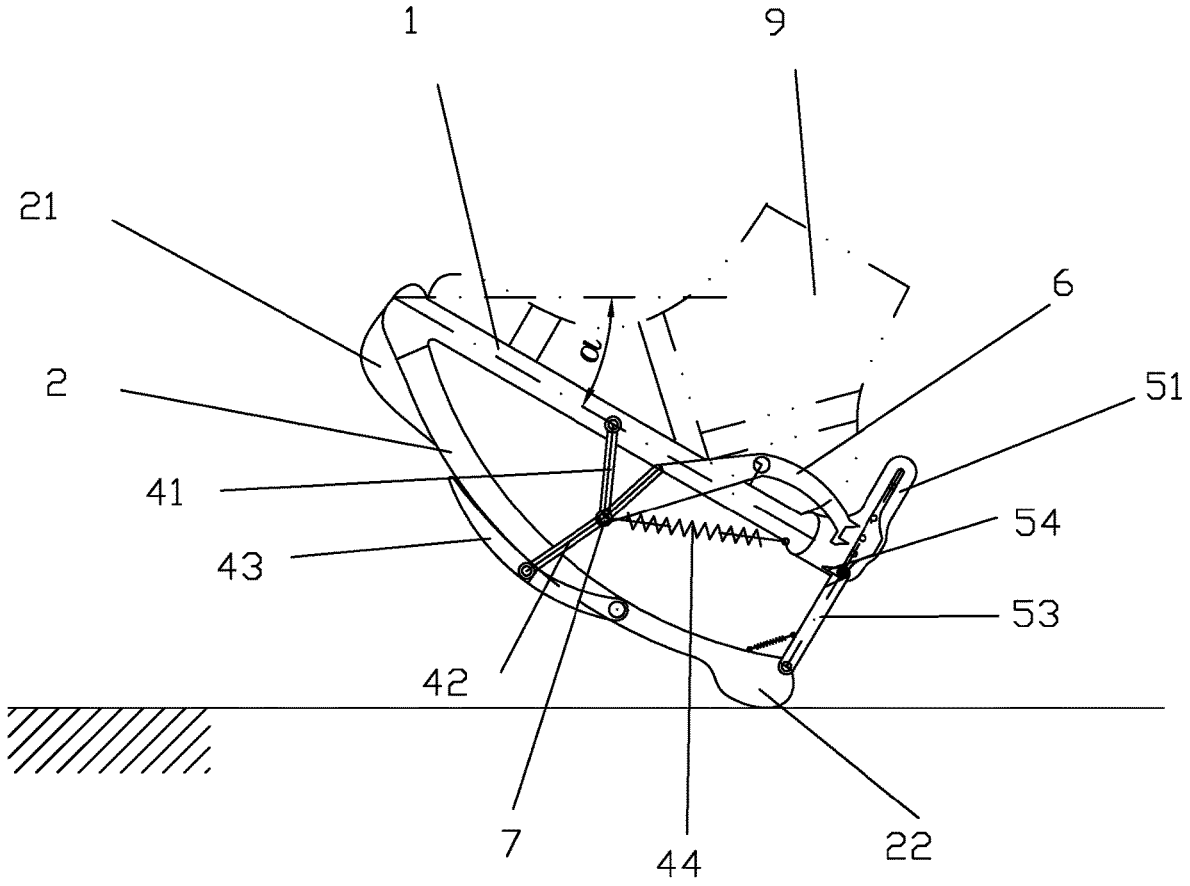

FIG. 2 is a schematic view of the plantar energy storage booster according to the preferred embodiment of the present invention, illustrating an elastic plate being deformed and storing an energy when the heel is pressed downward.

Figure 3:
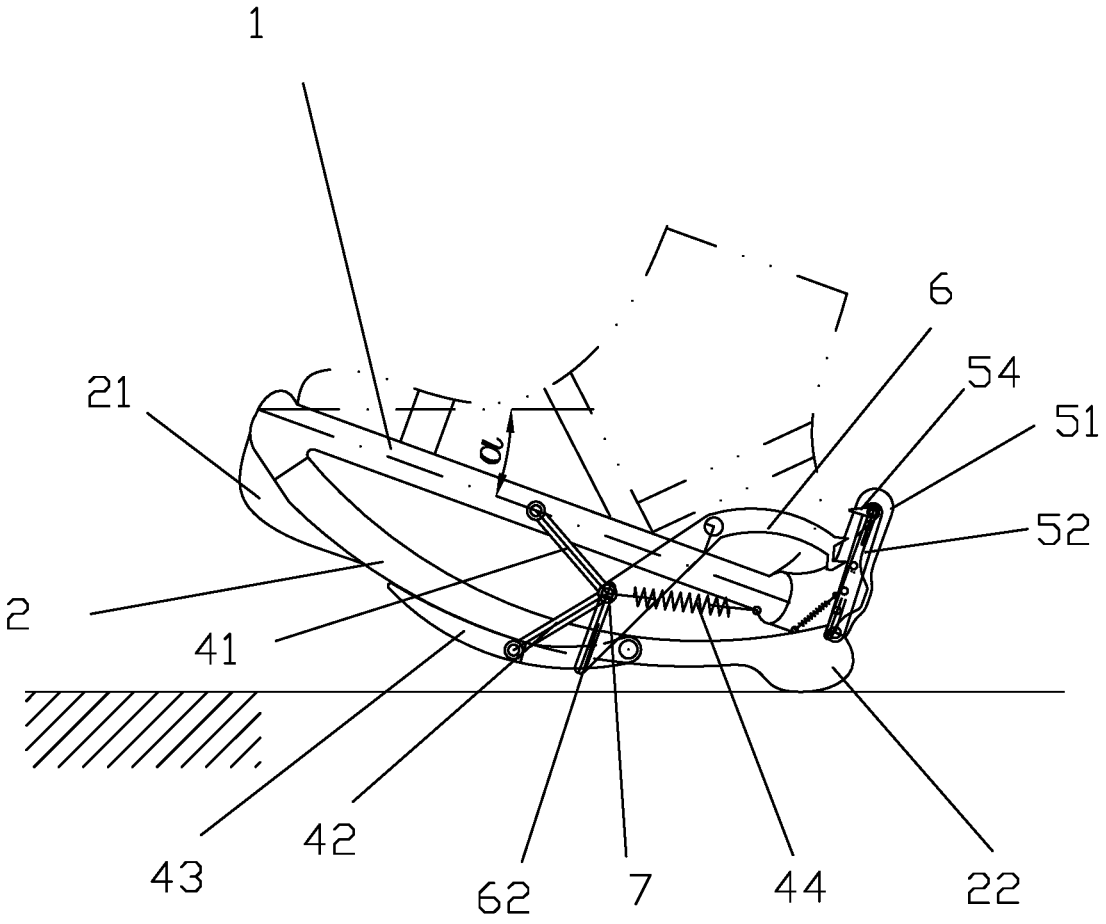

FIG. 3 is a schematic view of the plantar energy storage booster according to the preferred embodiment of the present invention, illustrating the deformed elastic plate in FIG. 2 at the largest heel impact force.

Figure 4:
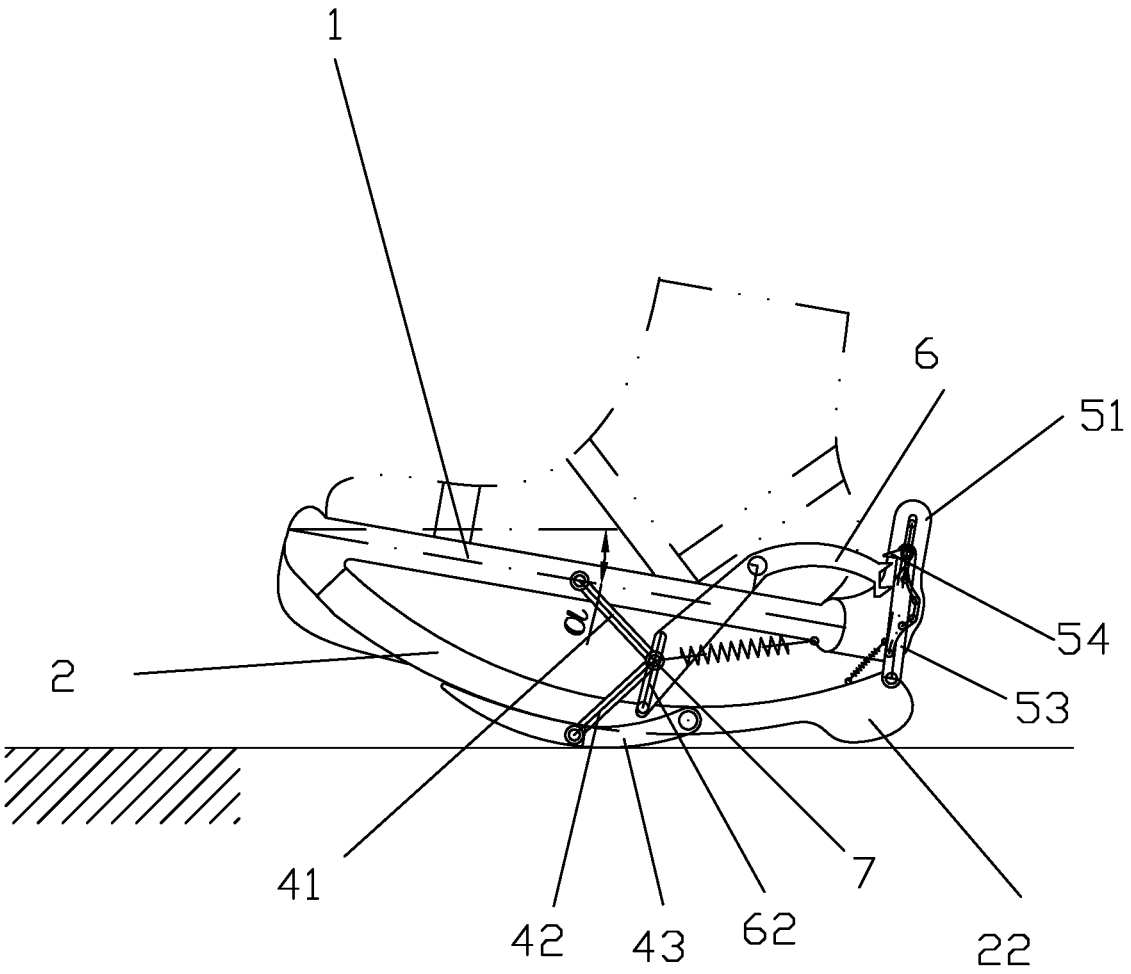

FIG. 4 is a schematic view of the plantar energy storage booster according to the preferred embodiment of the present invention, illustrating a thrust assembly being driven by the elastic plate in FIG. 3 when the heel starts to lift and the elastic plate is ready to release energy.

Figure 5:
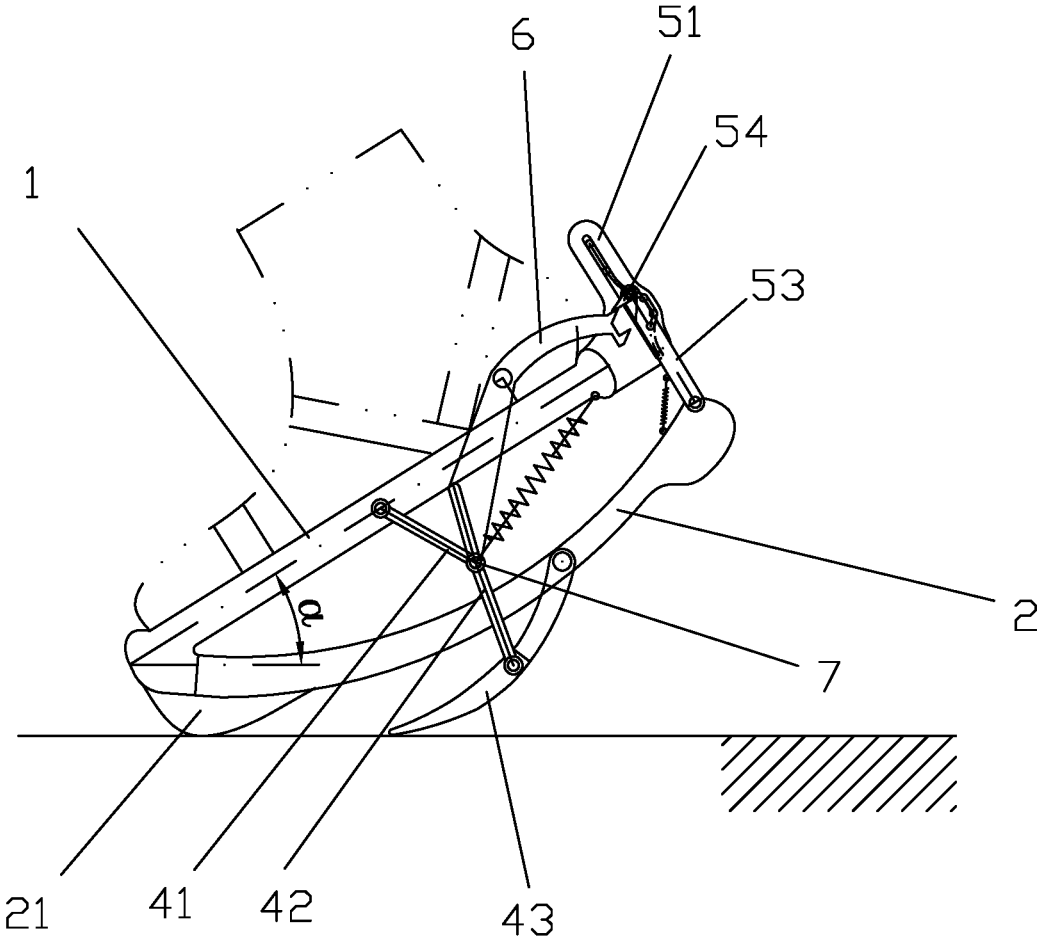

FIG. 5 is a schematic view of the plantar energy storage booster according to the preferred embodiment of the present invention, illustrating the elastic plate in FIG. 4 converting the stored energy into an upward and forward thrust on the sole of the athlete's foot when the toe is ready to touch the ground.

Figure 6:
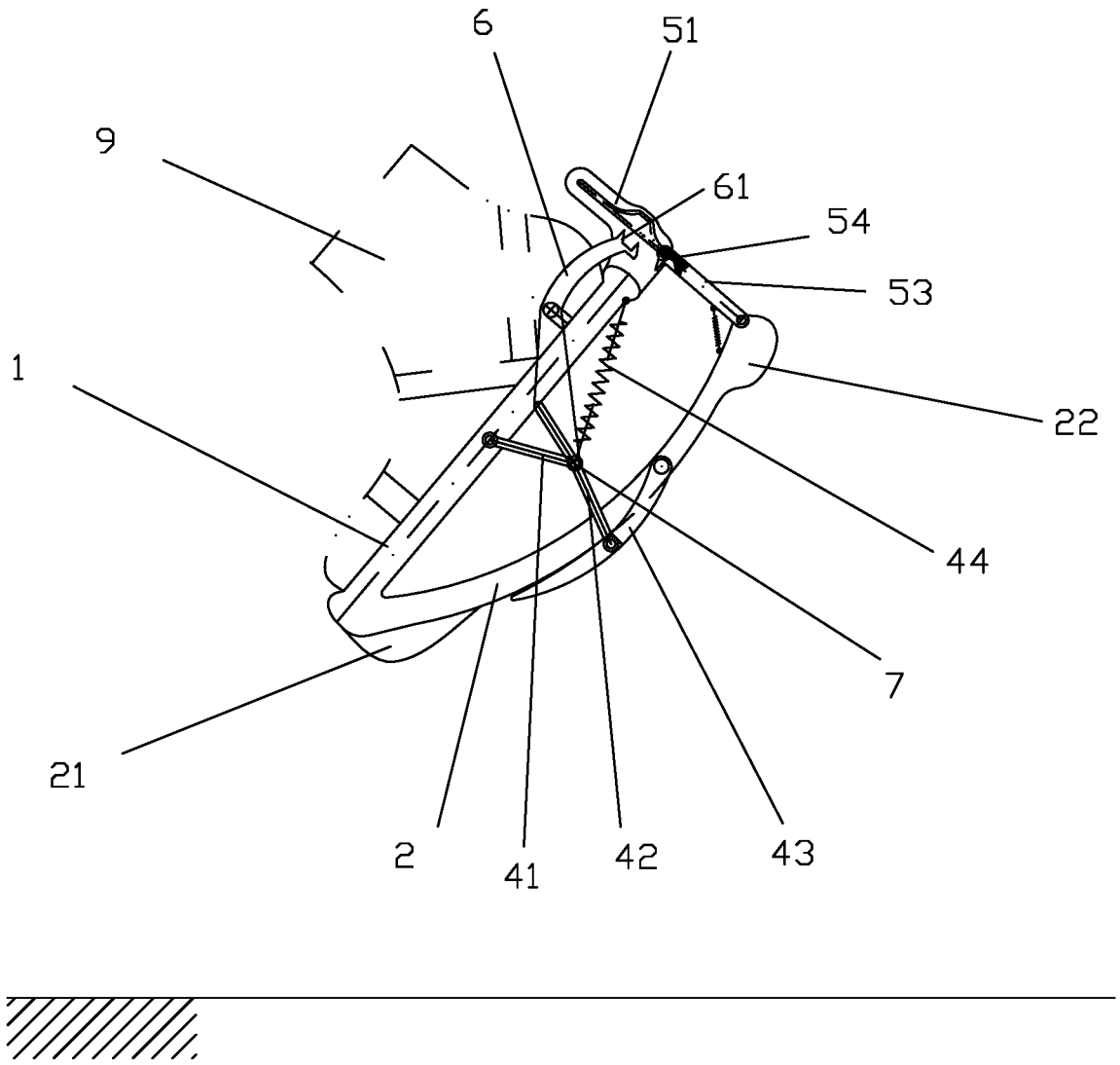

FIG. 6 is a schematic view of the plantar energy storage booster according to the preferred embodiment of the present invention, illustrating the elastic plate returning back to its natural initial state when the athlete's foot is in the air and is ready to touch the ground again to store energy.

Figure 7:
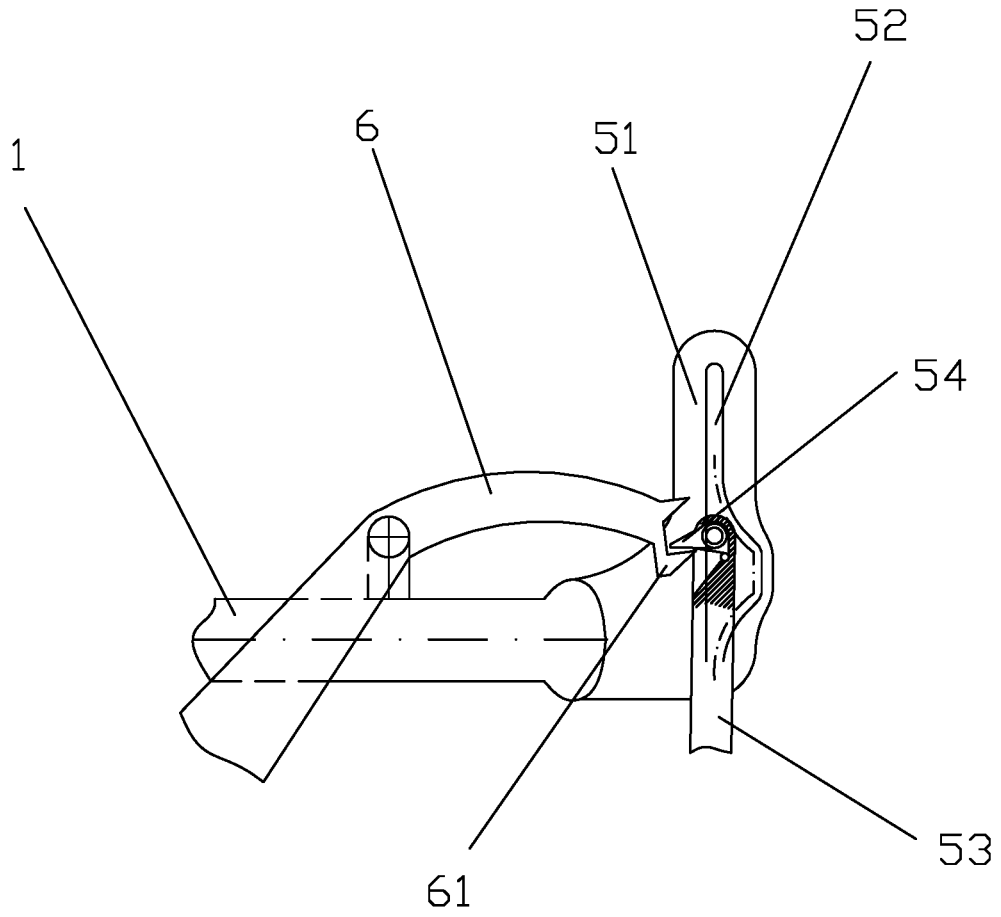

FIG. 7 is an enlarged schematic view of a starting assembly of the plantar energy storage booster according to the preferred embodiment of the present invention, illustrating the starting assembly in FIG. 1 to have different hanging teeth at different heights.

The reference signs areas follows: Fixed plate 1, Elastic plate 2, Front supporting leg 21, Rear supporting leg 22, Energy storage gap 3, Thrust assembly 4, Upper link 41, Lower link 42, Booster arm 43, Reset spring 44, Starting assembly 5, Guiding member 51, Guiding groove 52, Driving rod 53, Ratchet tooth 54, Return spring 55, Tension spring 56, Swing lever 6, Hanging tooth 61, Sliding groove 62, Suspended pivot hinge 7, Plantar energy storage booster 8, Foot 9.

BEST PREFERRED EMBODIMENT FOR CARRYING OUT THE INVENTION

Best Mode of the Present Invention

I. Planter Energy Storage Booster 8

The present invention provides a planter energy storage booster 8 for being worn by an athlete's foot, wherein the planter energy storage booster 8 is adapted for storing part of an impact energy generated by the athlete's heel contacting on the ground during the exercise. The stored energy is fed back to the sole of the foot at the moment when the heel is lifted off the ground so as to help the foot 9 to leave the ground quickly.

1. The Basic Structure of the Present Invention

Referring to FIGS. 1 to 6 of the drawings, the planter energy storage booster 8 comprises a fixed plate 1 and an elastic plate 2.

The fixed plate 1 is embodied as a flat plate made of metal, plastic, or composite material to provide a predetermined rigidity, wherein the fixed plate 1 can be worn at the sole of the foot by any wearing device.

The elastic plate 2 is made of high elastic deformable material, wherein the elastic plate 2, according to the preferred embodiment, is preferably made of composite material with light weight and good elastic energy storage abilities. The elastic plate 2 has a circular arc shape at a longitudinal direction of the elastic plate 2 (the longitudinal direction refers to a longitudinal direction from the toe to the heel, same as below). The elastic plate 2 is located under the fixed plate 1, wherein the elastic plate 2 has a front end securely coupled at a front end of the fixed plate 1. Via a connector, the front end the elastic plate 2 and the front end of the fixed plate 1 can be integrally coupled with each other. The elastic plate 2 further has a rear end spaced apart from a rear end of the fixed plate 1 to define an energy storage gap 3 as a vertical distance between the rear end of the elastic plate 1 and the rear end of the fixed plate 1 when the elastic plate 2 is in a natural initial state (the natural initial state refers to a state where the plantar energy storage booster 8 is not being used and placed in nature).

A process of storing energy is that: the elastic plate 2 is supported on the ground, wherein when the athlete's heel starts to contact the ground, i.e., when the heel presses on the rear end of the elastic plate 2 as a fulcrum to apply vertical force to the fixed plate 1, the energy storage gap 3 at a distance between the rear end of the elastic plate 1 and the rear end of the fixed plate 1 will be gradually decreased. At the meantime, portions of the impact force of the heel on the fixed plate 1 and the weight of the user are converted into elastic energy being stored in the elastic plate 2.

A process of releasing energy is that: when a point of force by the downward force exerted by the athlete's foot 9 is gradually shifted from the heel to the sole and forefoot, i.e., when the angle $\alpha$ changes, the force applied to the rear end of the fixed plate 1 is released, and the elastic energy stored in the elastic plate 2 will force the elastic plate 2 to return to its original form and shape so as to generate an upward force on the fixed plate 1.

Through the above processes of storing and releasing energy, the athlete can relax during the exercise, i.e., the heel will not feel any counter impact force when it strikes on the ground. Meanwhile, when the athlete lifts his or her heel, the athlete will feel a boost force that prompts the foot 9 to lift up quickly.

For different athletes having different ages and different weights, the energy storage gap 3 is adjustably set in a range between 30 mm and 150 mm.

The elastic plate 2 further comprises a front supporting leg 21 and a rear supporting leg 22 provided at the front end and the rear end of the elastic plate 2 respectively, wherein each of the front and rear supporting legs 21, 22 has a curved bottom surface. The front supporting leg 21 is configured to support the elastic plate 2 before the elastic plate 2 is lifted from the ground and the rear supporting leg 22 is configured to support the elastic plate 2 after the elastic plate contacts the ground. Therefore, the front and rear supporting legs 21, 22 not only facilitate the elastic plate 2 to land and lift off the ground but also prolong the service life span of the elastic plate 2 to avoid long-term direct ground contacting for wear and tear.

2. The Preferred Structure of the Present Invention

In order to more effectively release the energy stored in the elastic plate 2 to the fixed plate 1, the present invention further comprises a boosting mechanism provided between the fixed plate 1 and the elastic plate 2, wherein the boosting mechanism is configured to convert kinetic energy stored in the elastic plate 2 into an upward and forward pushing force to be applied to the fixed plate 1 after the heel is lifted.

The boosting mechanism comprises a thrust assembly 4 and a starting assembly 5. The starting assembly 5 is configured to trigger the thrust assembly 4 to start working after the heel is lifted. The thrust assembly 4 is driven by the starting assembly 5 to generate an upward and forward thrust force to the fixed plate 1.

1) Starting Assembly 5

The rear end of the fixed plate 1 is prolonged, i.e. the rear end of the fixed plate 1 is further extended backward from the heel.

The starting assembly 5 comprises a guiding member 51 provided at the rear end of the fixed plate 1, wherein the guiding member 51 has a front end mounted on top of the fixed plate 1. The starting assembly 5 has a guiding groove 52 provided at the guiding member 51, wherein the guiding groove 52 is upwardly extended at a rear end of the guiding member 51.

The starting assembly 5 further comprises a driving rod 53 provided at the rear end of the elastic plate 2 and being moved up and down along the guiding groove 52.

The starting assembly 5 further comprises a ratchet tooth 54 provided at an upper end of the driving rod 53, wherein the ratchet tooth 54 has an inclined upper surface and a flat lower surface. The starting assembly 5 further comprises a return spring 55 coupled at the flat lower surface of the ratchet tooth 54 to apply a spring force thereto so as to ensure the ratchet tooth 54 being moved in an upright manner. Taking an orientation as an example in FIG. 1, the ratchet tooth 54 is allowed to rotate in a counterclockwise direction via the return spring 55 at a predetermined angle (the ratchet tooth 54 can also be replaced by a ratchet wheel, i.e. when the driving rod 53 is moved upwardly and when the ratchet wheel contacts an obstacle, the ratchet wheel can rotate counterclockwise freely, and the driving rod 53 moves downward, and when the ratchet wheel contacts the obstacle, the ratchet wheel is stuck on the obstacle).

A lower end of the driving rod 53 is hinged or elastically coupled at the rear end of the elastic plate 2, wherein the driving rod 53 with the ratchet tooth 54 are adapted to move up and down along the guiding groove 52.

The starting assembly 5 further comprises a swing lever 6 pivotally coupled at a mid-portion of the fixed plate 1, wherein the swing lever 6 has an arc-shaped configuration and a width gradually increased from a rear end of the swing lever 6 to a front end thereof (i.e. the front end of the swing lever 6 refers to a direction of the toes and the rear end of the swing lever 6 refers to a direction of the heel, same as below). The rear end of the swing lever 6 is a free end. The starting assembly 5 further comprises at least one hanging tooth 61 provided on an end surface of the free end of the swing lever 6, wherein the hanging tooth 61 is a protruding tooth rearwardly extended from the rear end of the swing lever 6. According to the preferred embodiment, two hanging teeth 61 are spacedly provided at the rear end of the swing lever 6 to serve as an upper hanging tooth and a lower hanging tooth, wherein each of the hanging teeth 61 has a flat upper surface and an inclined lower surface inclinedly and upwardly extended from front to back.

The swing lever 6 has a front inclined surface at a front end thereof extending from an upper rear to a lower front, and a sliding groove 62 formed at the front inclined surface, wherein the thrust assembly 4 is coupled at the sliding groove 62 of the swing lever 6 to slide up and down along the sliding groove 62.

When the driving rod 53 is moved upwardly along the guiding groove 52 to the bottom of the hanging tooth, the ratchet tooth 54 is able to slide at and pass the inclined lower surface of the hanging tooth without causing the swing lever 6 to swing. When the driving rod 53 is moved downwardly along the guiding groove 52 at a position above the hanging tooth, the ratchet tooth 54 is engaged with the flat upper surface of the hanging tooth to force the rear end of the swing lever 6 to swing downward. At the meantime, the front end of the swing lever 6 is driven to swing upward and forward, and the lower end of the front inclined surface of the swing lever 6 is driven to push forward.

2) Thrust Assembly 4

The thrust assembly 4 comprises a reset spring 44, an upper link 41, a lower link 42, and a booster arm 43. The reset spring 44, the upper link 41 and the lower link 42 are placed between the fixed plate 1 and the elastic plate 2, wherein the booster arm 43 is placed under the elastic plate 2. The upper link 41, the lower link 42 and the swing lever 6 are made of rigid and high-strength materials, wherein the booster arm 43 is made of high-strength and tenacity materials.

The upper link 41, which is embodied as an upper linking rod, has an upper end pivotally coupled at a mid-portion of the fixed plate 1, and a lower end pivotally coupled at an upper end of the lower link 42 to form a suspended pivot hinge 7 between the fixed plate 1 and the elastic plate 2.

The lower link 42, which is embodied as a lower linking rod, has a lower end pivotally coupled to a mid-portion of the booster arm 43.

The booster arm 43 is formed in a circular arc-shaped plate configuration, wherein the booster arm 43 has a front end as a free end, and a rear end pivotally coupled to the mid-rear portion of the elastic plate 2.

The reset spring 44 has an upper rear end fixedly coupled to the rear end of the fixed plate 1, and a lower front end coupled to the suspended pivot hinge 7.

The suspended pivot hinge 7 is movably coupled at the sliding groove 62 formed at the front inclined surface of the swing lever 6 through a short arm support shaft.

When the ratchet tooth 54 on the driving rod 53 is moved from top to bottom to engage with and hang on the hanging tooth to drive the swing lever 6 downward, the suspended pivot hinge 7 is driven to move forward at the sliding groove 62 at the front end of the swing lever 6 so as to enlarge an angle between the upper link 41 and the lower link 42. Since the lower end of the lower link 42 is pivotally coupled at the booster arm 43, when the suspended pivot hinge 7 is moved forward, the free end of the booster arm 43 is configured to apply a force to the ground. Meanwhile, a reaction force is generated to push the fixed plate 1 upward and forward through the lower link 42 and the upper link 41.

The starting assembly 5 is configured in a set provided at a rear-mid portion of the fixed plate 1.

The thrust assembly 4 is preferably configured in two sets provided at two lateral sides of the fixed plate 1 respectively. Particularly, the lower ends of the lower links 42 of the two sets of thrust assemblies 4 are pivotally coupled at two lateral sides of the booster arm 43 respectively. In other words, the thrust assembly 4 is constructed to have two upper links 41, two lower links 42, two reset springs 44, and one booster arm 43. For each set of the thrust assembly 4, the hanging tooth 61 is integrally extended from the free end of the swing lever 6. Therefore, the swing levers 6 in the two sets of thrust assemblies 4 are driven to move synchronously by the ratchet tooth 54 at the driving rod 53 in one set of the starting assembly 5.

The present invention will be further described below in conjunction with the accompanying drawings.

As shown in FIGS. 2 and 3, when the heel contacts on the ground at the back supporting leg 22 of the elastic plate 2, under the combined action of the impact ground force and the weight of the user, the elastic plate 2 begins to be compressed and deformed, such that the energy storage gap 3 is reduced. At the meantime, the elastic plate 2 is configured to absorb the impact ground force and convert it into a stored energy. During the deformation and energy storage process of the elastic plate 2, the elastic plate 2 is moved upward relative to the fixed plate 1, wherein the driving rod 53 coupled at the elastic plate 2 is correspondingly moved upward in the guiding groove 52. When the driving rod 53 is moved upwardly, the driving rod 53 is adapted to move up along a straight portion of the guiding groove 52 under the action of the tension spring 56 or the forward elastic force connected with the elastic plate 2. Since the lower end of the driving rod 53 is pivotally or elastically connected to the elastic plate 2, an upper portion of the driving rod 53 is able to smoothly move up and down in the guiding groove 52. As the driving rod 53 is moved upwardly, the ratchet tooth 54 thereon is also moved upwardly to smoothly slide over the hanging tooth 61 provided at the rear end of the swing lever 6.

When the energy storage gap 3 is getting smaller, the reset spring 44 placed between the elastic plate 2 and the fixed plate 1 is configured to pull the suspended pivot hinge 7 to move backward and to pull the free end of the booster arm 43 laying on a bottom surface of the elastic plate 2.

When the energy storage gap 3 is compressed to its minimum limit position, the ratchet tooth 54 is lifted to its highest position in the guide groove 52.

As shown in FIGS. 4 and 5, when the athlete's heel is lifted up, i.e., when the angle $\alpha$ is changed and starts to release the pressure of the heel on the fixed plate 1, the energy stored in the elastic plate 2 also begins to release by restoring the elastic plate 2 back to its original form, i.e. the natural initial state, through the energy storage gap 3. Meanwhile, the driving rod 53 is moved to drive the ratchet tooth 54 to move from top to bottom. Initially, the ratchet tooth 54 at the highest position cannot contact the hanging tooth 61 at the swing lever 6. However, during the restoring process of the elastic plate 2 back to its original form, the elastic plate 2 will generate an upward and forward boosting force on the foot 9 of the athlete.

Then, when the elastic plate 2 is configured to pull the driving rod 53 to continue to move downward, the ratchet tooth 54 is contacted with and is engaged with the hanging tooth 61 in order to force the rear end of the swing lever 6 to swing downward. When the front end of the swing lever 6 is moved upward, the suspended pivot hinge 7 connected thereto is driven to move forward at the sliding groove 62 provided at the front end of the swing lever 6. The angle between the upper link 41 and the lower link 42 is enlarged, such that a distance between a point of the fixed plate 1 where the upper end of the upper link 41 connecting thereto and a point of the booster arm 43 where the lower end of the lower link 42 connecting thereto is increased. Since the free end of the front end of the booster arm 43 is on the ground, the increased distance will generate an upward and forward thrust to the fixed plate 1.

As shown in FIG. 5, as the foot 9 continues to lift upward, i.e., when the angle $\alpha$ is changed, the fulcrum of the foot is gradually transferred from the free end of the booster arm 43 to the front supporting leg 21 at the front end of the elastic plate 2. The elastic plate 2 is basically restored back to its natural initial state, and the rear end of the swing lever 6 is swung close to its lower limit position. At this time, the ratchet tooth 54 at the driving rod 53 begin to slide at a curving portion of the guiding groove 52 to move downwardly and rearwardly so as to gradually disengage with the hanging tooth 61 at the rear end of the swing lever 6, such that the ratchet tooth 54 is moved back to its original position along with the downward movement of the driving rod 53. Then, the elastic plate 2 is completes its energy releasing and boosting process.

As shown in FIG. 6, the athlete's foot is lifted in the air and is ready for the next landing action. Under the pull force of the reset spring 44, the suspended pivot hinge 7 is moved backward and the booster arm 43 is retracted back to rest on the bottom surface of the elastic plate 2.

As shown in FIG. 7, when the stored energy of the elastic plate 2 has not reached its maximum value, the ratchet tooth 54 on the driving rod 53 can be selectively engaged with different hanging teeth 61, i.e. the upper or lower hanging tooth according to the relative height from the ground, at the rear end of the swing lever 6, such that different driving forces at different levels of the booster arm 43 will be formed.

II. Plantar Booster

The above mentioned upper link 41, the lower link 42, the booster arm 43, and the swing lever 6 are constructed to form a plantar booster for being used in different configurations of the plantar supports and elastic energy storage plates. The connection configuration is shown as follows: The lower end of the upper link 41 and the upper end of the lower link 42 are pivotally coupled to the front end of the swing lever 6. The lower end of the lower link 42 is pivotally coupled at the mid-portion of the booster arm 43. The upper end of the upper link 41 and the rear end of the booster arm 43 are pivotally coupled at different height points of plantar support and elastic energy storage plate respectively, wherein the plantar support and elastic energy storage plate are positioned at different heights, such that by configuring the front end of the booster arm 43 as a fulcrum and driving the swing lever 6 to move forward, the upper end of the upper link 41 can exert an upward thrust on the hinged plantar support.

What is claimed is:

1. A plantar energy storage booster, comprising a fixed plate and an elastic plate;

wherein said fixed plate is arranged for being placed on a sole of a foot and worn by the foot of a user, wherein a rear end of said fixed plate is configured to extend behind a heel of the user;

wherein said elastic plate is made of elastic deformable material, wherein said elastic plate is formed in an arc-shape along its longitudinal sectional direction, wherein said elastic plate is located below said fixed plate, wherein in a natural initial state, said elastic plate has a front end fixedly connected to a front end of said fixed plate and a rear end spaced apart from a rear end of said fixed plate to define an energy storage gap therebetween in a vertical direction;

wherein said energy storage gap is gradually reduced when said rear end of said elastic plate as a fulcrum is pressed downwardly via a vertical pressure applied by said heel to said fixed plate, at the meantime, wherein said elastic plate is forced to be deformed for storing a portion of kinetic energy generated by the vertical pressure exerted by the heel to said fixed plate for deforming said elastic plate, wherein said plantar energy storage booster further comprises:

a boosting mechanism provided between said fixed plate and said elastic plate for converting the kinetic energy stored in said elastic plate into an upward and forward force to be applied to said fixed plate after the heel is lifted, wherein said boosting mechanism comprises a thrust assembly provided at mid-portions of said fixed plate and said elastic plate, and a starting assembly provided at said rear ends of said fixed plate and said elastic plate, said starting assembly is configured to trigger said thrust assembly to start working after the heel is lifted, and said thrust assembly is configured to be driven by said starting assembly to generate the upward and forward force to the fixed plate, wherein said starting assembly comprises a guiding member provided at said rear end of said fixed plate, a driving rod provided at said rear end of said elastic plate and extended upwardly, and a swing lever pivotally coupled at a mid-portion of said fixed plate, wherein said guiding member has a front end coupled at said fixed plate, wherein a guiding groove is upwardly extended and provided at a rear end of said guiding member, wherein said starting assembly further comprises a ratchet tooth provided at an upper end of said driving rod, wherein a lower end of said driving rod is coupled to said elastic plate, wherein said driving rod with said ratchet tooth are arranged to move up and down along said guiding groove, wherein said swing lever has an arc-shaped configuration and a width gradually increased from a rear end of said swing lever to a front end thereof, wherein said rear end of said swing lever is a free end and comprises at least one hanging tooth, wherein said front end of said swing lever has an inclined lower surface inclinedly and upwardly extended from front to back, wherein a sliding groove is formed at said front inclined surface, wherein said thrust assembly is coupled at the sliding groove of said swing lever to slide up and down along said sliding groove, wherein said ratchet tooth is able to freely slide at and pass said ng tooth when moving upward from a bottom of said hanging tooth, and is engaged with said hanging tooth when moving downward from a top of said hanging tooth, wherein when said ratchet tooth is continuously moved downward via said driving rod, said ratchet tooth is configured to drive said swing lever to swing and push a lower end of said front inclined surface of said swing lever forward.

2. The plantar energy storage booster, as recited in claim 1, wherein said energy storage gap is set between 30 mm and 150 mm.

3. The plantar energy storage booster, as recited in claim 2, wherein said elastic plate further comprises a front supporting leg and a rear supporting leg provided at said front end and said rear end of said elastic plate respectively, wherein each of said front and rear supporting legs has a curved bottom surface.

4. The plantar energy storage booster, as recited in claim 1, wherein said elastic plate further comprises a front supporting leg and a rear supporting leg provided at said front end and said rear end of said elastic plate respectively, wherein each of said front and rear supporting legs has a curved bottom surface.

5. The plantar energy storage booster, as recited in claim 4, wherein said thrust assembly comprises a reset spring, an upper link, a lower link, and a booster arm, wherein said upper link has an upper end pivotally coupled at a mid-portion of said fixed plate, and a lower end pivotally coupled at an upper end of said lower link to form a suspended pivot hinge between said fixed plate and said elastic plate, wherein said lower link has a lower end pivotally coupled to a mid-portion of said booster arm, wherein said booster arm is formed in a circular arc-shaped plate configuration, wherein said booster arm has a front end as a free end, and a rear end pivotally coupled to said mid-rear portion of said elastic plate, wherein said reset spring has an upper rear end fixedly coupled to said rear end of said fixed plate, and a lower front end coupled to said suspended pivot hinge, wherein said suspended pivot hinge is movably coupled at said sliding groove through a short arm support shaft.

6. A plantar energy storage booster, comprising a fixed plate and an elastic plate;

wherein said fixed plate is arranged for being placed on a sole of a foot and worn by the foot of a user, wherein a rear end of said fixed plate is configured to extend behind a heel of the user;

wherein said elastic plate is made of elastic deformable material, wherein said elastic plate is formed in an arc-shape along its longitudinal sectional direction, wherein said elastic plate is located below said fixed plate, wherein in a natural initial state, said elastic plate has a front end fixedly connected to a front end of said fixed plate and a rear end spaced apart from a rear end of said fixed plate to define an energy storage gap therebetween in a vertical direction;

wherein said energy storage gap is gradually reduced when said rear end of said elastic plate as a fulcrum is pressed downwardly via a vertical pressure applied by said heel to said fixed plate, at the meantime, wherein said elastic plate is forced to be deformed for storing a portion of kinetic energy generated by the vertical pressure exerted by the heel to said fixed plate for deforming said elastic plate, wherein said plantar energy storage booster further comprises:

a boosting mechanism provided between said fixed plate and said elastic plate for converting the kinetic energy stored in said elastic plate into an upward and forward force to be applied to said fixed plate after the heel is lifted, wherein said boosting mechanism comprises a thrust assembly provided at mid-portions of said fixed plate and said elastic plate, and a starting assembly provided at said rear ends of said fixed plate and said elastic plate, said starting assembly is configured to trigger said thrust assembly to start working after the heel is lifted, and said thrust assembly is configured to be driven by said starting assembly to generate the upward and forward force to the fixed plate, wherein an upper link, a lower link, a booster arm and a swing lever are placed between said fixed plate and said elastic plate, wherein said upper link has an upper end pivotally coupled at a mid-portion of said fixed plate, and a lower end pivotally coupled at an upper end of said lower link to form a suspended pivot hinge between said fixed plate and said elastic plate, wherein said lower link has a lower end pivotally coupled to a mid-portion of said booster arm, wherein said booster arm is formed in a circular arc-shaped plate configuration, wherein said booster arm has a front end as a free end, and a rear end pivotally coupled to said mid-rear portion of said elastic plate, wherein said swing lever has a mid-portion pivotally coupled at said fixed plate, a sliding groove formed at a front end of said swing lever to couple at said suspended pivot hinge, and a rear end extended to and on top of said rear end of said fixed plate, wherein said swing lever is driven to move said suspended pivot hinge forward to enlarge an angle between said upper link and said lower link.

7. The plantar energy storage booster, as recited in claim 6, wherein said upper link, said lower liner and said swing lever are made of a rigid material.

8. A plantar energy storage booster, comprising a fixed plate and an elastic plate;

wherein said fixed plate is arranged for being placed on a sole of a foot and worn by the foot of a user, wherein a rear end of said fixed plate is configured to extend behind a heel of the user;

wherein said elastic plate is made of elastic deformable material, wherein said elastic plate is formed in an arc-shape along its longitudinal sectional direction, wherein said elastic plate is located below said fixed plate, wherein in a natural initial state, said elastic plate has a front end fixedly connected to a front end of said fixed plate and a rear end spaced apart from a rear end of said fixed plate to define an energy storage gap therebetween in a vertical direction;

wherein said energy storage gap is gradually reduced when said rear end of said elastic plate as a fulcrum is pressed downwardly via a vertical pressure applied by said heel to said fixed plate, at the meantime, wherein said elastic plate is forced to be deformed for storing a portion of kinetic energy generated by the vertical pressure exerted by the heel to said fixed plate for deforming said elastic plate, wherein said plantar energy storage booster further comprises:

a boosting mechanism provided between said fixed plate and said elastic plate for converting the kinetic energy stored in said elastic plate into an upward and forward force to be applied to said fixed plate after the heel is lifted, wherein said boosting mechanism comprises a thrust assembly provided at mid-portions of said fixed plate and said elastic plate, and a starting assembly provided at said rear ends of said fixed plate and said elastic plate, said starting assembly is configured to trigger said thrust assembly to start working after the heel is lifted, and said thrust assembly is configured to be driven by said starting assembly to generate the upward and forward force to the fixed plate, wherein said thrust assembly comprises a reset spring, an upper link, a lower link, and a booster arm, wherein said upper link has an upper end pivotally coupled at a mid-portion of said fixed plate, and a lower end pivotally coupled at an upper end of said lower link to form a suspended pivot hinge between said fixed plate and said elastic plate, wherein said lower link has a lower end pivotally coupled to a mid-portion of said booster arm, wherein said booster arm is formed in a circular arc-shaped plate configuration, wherein said booster arm has a front end as a free end, and a rear end pivotally coupled to said mid-rear portion of said elastic plate, wherein said reset spring has an upper rear end fixedly coupled to said rear end of said fixed plate, and a lower front end coupled to said suspended pivot hinge, wherein said suspended pivot hinge is movably coupled at said sliding groove through a short arm support shaft.

* * * * *